US007107812B1

(12) United States Patent
Patton et al.

(10) Patent No.: US 7,107,812 B1
(45) Date of Patent: Sep. 19, 2006

(54) HYDRAULIC RESCUE TOOL

(76) Inventors: Tommy L. Patton, 1495 W. 9th St., Bldg. 101, Upland, CA (US) 91786; Donald L. Ankerstar, 311 Beechwood La., San Dimas, CA (US) 91773

( * ) Notice: Subject to any disclaimer, the term of this patent is extended or adjusted under 35 U.S.C. 154(b) by 99 days.

(21) Appl. No.: 10/987,908

(22) Filed: Nov. 15, 2004

(51) Int. Cl.
*B21D 41/02* (2006.01)

(52) U.S. Cl. ..... 72/392; 72/453.16; 72/464; 72/705

(58) Field of Classification Search ..... 72/392, 72/705, 464, 477, 482.92, 453.16, 453.15; 254/93 R; 92/172, 255
See application file for complete search history.

(56) References Cited

U.S. PATENT DOCUMENTS 4,171,616 A * 10/1979 Keigley ..... 60/477
4,273,311 A * 6/1981 Rio ..... 254/93 R
4,333,330 A * 6/1982 Porter ..... 72/392
4,392,263 A * 7/1983 Amoroso ..... 7/100
4,506,445 A * 3/1985 Esten ..... 30/228
4,734,983 A * 4/1988 Brick ..... 30/228
4,896,862 A * 1/1990 Ganley ..... 254/1
4,973,028 A * 11/1990 Linster ..... 254/93 R
5,243,761 A * 9/1993 Sullivan et al. ..... 30/134
5,301,533 A * 4/1994 Jackson ..... 72/328
5,406,826 A * 4/1995 Kuhlmann et al. ..... 72/392
5,544,862 A * 8/1996 Hickerson ..... 254/124
5,622,353 A * 4/1997 Painter et al. ..... 254/93 R
5,956,992 A * 9/1999 Patton ..... 72/392
6,092,290 A * 7/2000 Vogelsanger ..... 30/228
6,244,568 B1 * 6/2001 Patton ..... 254/93 R

* cited by examiner

*Primary Examiner*—Derris H. Banks
*Assistant Examiner*—Teresa M Bonk
(74) *Attorney, Agent, or Firm*—Albert O. Cota

(57) ABSTRACT

A hydraulic rescue tool (20) that utilizes a hydraulic cylinder (22) having a piston rod (24) that is movably disposed within the housing of the cylinder to provide linear driving means for the rescue tool. A cylinder yoke (32) is rotatably attached to the hydraulic cylinder housing and includes a front handle bar (34) for manipulating the tool. Rotation of the cylinder yoke (32) relative to the cylinder (22) prevents injury to an operator in the event that the tool binds and torques. An implement unit (50), which is either a cutter (54) or a spreader (74), is detachably disposed onto the piston rod (24). Pivotal links (36) connect the unit (50) to the cylinder yoke (32), with the unit used for cutting or spreading metal during a rescue. A plurality of quick release pins (72) attach the implement unit (50) to the piston rod (24) and pivotal links, thus providing a rapid release of the implement unit (50) from the piston rod (24) and links (36) for replacement or repair. The piston rod (24) has a rebated diameter (82) on its internal end that is at least two times smaller than the piston. This reduction in diameter provides additional surface area for hydraulic pressure when retracting an attached implement unit.

19 Claims, 8 Drawing Sheets

HYDRAULIC RESCUE TOOL

TECHNICAL FIELD

The invention generally pertains to rescue tools used for emergency rescue operations, and more specifically to a hydraulic tool that provides spreading, crushing or cutting with a quick detachable blade or spreader unit.

BACKGROUND ART

Previously, many types of rescue tools have been used to provide an effective means to pry or cut open a damaged vehicle at the scene of an accident. Other machine tools have also been developed with similar operational characteristics.

A search of the prior art did not disclose any patents that read directly on the claims of the instant invention, however the following U.S. patents are considered related:

| U.S. Pat. No. | Inventor | Issue Date |
|---|---|---|
| 6,244,568 | Patton | Jun. 12, 2001 |
| 5,956,992 | Patton | Sep. 28, 1999 |
| 5,622,353 | Painter et al. | Apr. 22, 1997 |
| 5,301,533 | Jackson | Apr. 12, 1994 |
| 4,734,983 | Brick | Apr. 5, 1988 |
| 4,392,263 | Amoroso | Jul. 12, 1983 |
| 4,333,330 | Porter | Jun. 8, 1982 |

Patton's own U.S. Pat. No. 6,244,568 teaches a rescue spreading tool that provides spreading, crushing or cutting. A stationary yoke is attached to a cylinder and pair of spreader arms are attached to the cylinder and are free to rotate in opposite directions. Integrally formed with the cylinder ram is a pusher cam yoke that engages the arms and pushes them apart when the ram is extended. A pair of toggle links attached to the yoke continue to push the arms apart, thus creating a secondary thrust.

U.S. Pat. No. 5,956,992 also issued to the instant inventor, Patton, is for the same utility as above and consists of a first arm which functions in combination with an interlocking second arm that operates with a drive yoke. Another yoke includes a pair of cam pins that traverse a cam slot in each arm, and a drive rod is connected to the drive yoke.

Painter et al in U.S. Pat. No. 5,622,353 discloses a rescue tool having a pair of spreader arms with a pivot point therebetween. A pair of links attached to the arms are reciprocally moveable between retracted and extended positions along an axis of movement. A third pivotal coupling couples the spreader arm pivot point to the housing.

U.S. Pat. No. 5,301,533 of Jackson discloses a machine tool that relates to manufacturing operations for gripping, clamping, piercing and hemming workpieces. Two pairs of arms are arranged in an opposed, inverted relationship with respect to each other and are pivotally connected at one end to a drive. Each arm has a cam formed therein. The cams in each pair of arms are identically constructed in an opposed inverted relationship. Cam followers are mounted on a linear drive member, which engages the cams during movement to pivot the arms between an open and closed position. Each cam has an arcuate shape at an obtuse angle with respect to a pivot pin connecting each pair of arms.

U.S. Pat. No. 4,734,983 issued to Brick teaches a cutting tool that is effective for cutting through sheet metal when extricating accident victims. The tool has one curved movable blade and one stationary blade. The stationary blade is formed on an anvil that is anchored within the frame of the tool and is locked within the frame with a dowel.

Amoroso in U.S. Pat. No. 4,392,263 teaches a rescue tool having a body with a cylinder and an outward extending piston. Jaw members are connected to the body with links and include outer prying portions, inner cutting portions and intermediate shearing portions. The tool may be powered by a bi-directional motor or directly from a wrecker motor vehicle system.

U.S. Pat. No. 4,333,330 issued to Porter is for a spreader tool that has opposed force arms that are separated and pivoted while mounted on a base member. The arms achieve annular movement in an opposite direction in response to axial movement of a driven piston of an associated jack. The arms have inner edges that rest upon rollers mounted on the forward end of the piston. The curve of the arm's inner edges forms an angle at which a constant axial force of the piston is applied to the arm by the roller such that the force is always constant.

For background purposes and as indicative of the art to which the invention is related, reference may be made to the remaining cited patents issued to Gehron in U.S. Pat. No. 5,425,260 and Forster et al in U.S. Pat. No. 4,886,635.

DISCLOSURE OF THE INVENTION

Most conventional scissor cutters used in rescue tools function in a similar manner: two blades rotate toward each other on a common pivot restraint. In the current rescue tool environment, the pivot is typically a generously sized bolt floating in a large clevis type yoke. Most applications require torque specifications of 150 to 250 foot pounds of torque on the bolt to allow the scissors to interface with each other and function properly. For comparison purposes, a cylinder head on a full size automobile engine is normally torqued to 85 to 90 foot pounds. The substantial force on the bolt is necessary to keep the cutting edges of the scissors in contact as they pass each other. The removal, replacement and maintenance of the blades requires large, robust tools to release or apply the necessary torque on the bolt, with the scissors mounted rigidly to a solid device such as a sturdy bench vice. It is obvious that the above procedures are difficult to accomplish in the field without the proper equipment, as was evidenced at the September 11 rescue site when factory maintenance teams were required to be sent to keep the tools functioning.

Other problems are encountered as a result of the extreme torque on the bolt which creates tremendous compression between the blades. The problems include lubrication and resistance of the blades when the high torque holds the cutting surfaces against each other, which tends to squeeze lubrication from the blades, thus causing galling and hence greater resistance. The tightness of the fit between the blades also causes an enormous amount of friction which adds excessive resistance to the hydraulic forces driving the tool. The excessive resistance robs the energy from the cutting action, and presents the possibility of blade failure at the pivot.

It is apparent when using a scissor cutter for extrication that the cutting surfaces, by their very nature, are inclined to twist as the top blade advances and bends metal out of the way to continue the cut. The bottom blade acts in the same manner by twisting the rescue tool in the same direction, with a heavier cut or a thicker blade amplifying the twisting condition. Training and practice with the tool is necessary to compel the operator to be cautious and aware that his/her hand may be trapped, with the tool causing considerable personal injury. Further, it is necessary to heat treat the scissor blades to maintain a sharp edge for cutting metal, which makes the blades brittle and easy to break. When the blades loose their edge, twisting becomes more apparent and cutting is very inefficient, which requires immediate repair or replacement.

Another extreme danger to the operator is blade failure when the blades twist, as they tend to become separated by the material being cut, thereby causing them to fracture, snap, bend or completely sever. When a cutter blade breaks, the broken piece may fly at high speed toward the operator or other rescue personnel, thus causing severe injury or even a fatality. It is well known that operators have sustained both minor to major injuries on the past from flying blades that have broken during extrications. When the blade or blades are broken or bent the tool must be removed from service and normally sent back to the dealer or factory for a trained technician to install a complete new set of blades as well as a new bolt with its required nut, washers and lock nut.

Therefore the primary object of the invention to provide a rotating cylinder that will alleviate this problem by rotating the cylinder yoke relative to the cylinder in the event that the tool binds and torques, thereby trapping an operator's hand. The rotation is accomplished at two points: the yoke which anchors the links to the cylinder and the end of the piston rod. In order to accomplish the rotation, the cylinder yoke is fabricated in two opposed pieces that include external lands machined into the interfacing surfaces of the yoke, and the hydraulic cylinder has a number of mating internal grooves. The piston rod employs a wet seal between the cylinder and the internal end of the piston rod, which is in turn attached to a piston sealing member with a threaded fastener. The arrangement of the sealing member interfacing with the inside of the hydraulic cylinder forms the wet seal, which permits both the yoke and the rod to revolve in unison from the hydraulic cylinder to protect an operator in the event that the tool binds and torques. The rotating feature is disabled by loading the tool. The axial stresses created by being fully open, fully closed or cutting will bind the lands against the grooves or interlocking elements in a side to side relationship. This binding action will create a normal handling tool which can be released by "backing off" slightly.

An important object of the invention is the quick disconnect implement unit, which is typically a cutter or spreader. The quick disconnect implement unit will allow a new set of pre-tensioned cutter blades or spreader arms to be installed on site in less than 90-seconds. This object is accomplished by releasing three quick disconnect pins that are located at the clevis and the links. It should be noted that the links may be released at either end, however the use of the quick disconnect pins is best served at the implement unit end, as a spare complete unit may be set up and properly adjusted at the factory or a repair facility and simply exchanged at the site.

Another object of the invention is the use of fail-safe blades. The unique fail-safe blades are designed to eliminate the danger of a broken blade or segment of a blade flying away and causing injury to either the operator or other people nearby. This object is accomplished by the use of a two-piece blade. Each cutting blade consists of a primary blade and a backup plate, with the primary blade having a sharp cutting edge and the backup plate having sufficient structural integrity to reinforce the primary blade and to preclude breakage and flying into pieces. The backup plate is fabricated of a high strength, ductile steel material using a process including machining, casting and forging a single element, or two-piece construction with the pieces welded together. The primary blade uses a hard material capable of holding a sharp edge and is protected by the backup plate. The primary blade and backup plate are preferably attached together using rivets, however bolts or brazing together in a furnace is also acceptable. The use of an imbedded safety cable to resist the launching of a portion of the blade in the event of a significant failure may be eliminated with this unique approach.

Still another object of the invention is that the prior art problem of extreme torque on the bolt holding the blades together, which creates compression between the blades, is relieved by the use of roller bearings between each blade. This improvement also solves the problem of lubrication and resistance of the blades when the high torque holds the cutting surfaces against each other, which tends to squeeze the lubrication from the blades, thus causing galling and undue resistance. The invention consists of the pair of opposed blades attached together with a number of thrust washers and roller bearings and held jointly with a pivot bolt and a pivot nut through a cutter clevis, which forces the cutting blades tightly together with the optimum resistance and clearance.

Yet another object of the invention is the use of fail-safe links. The links are designed with a predetermined weak point which will allow the link to bend when subjected to pressure significantly higher than standard operating pressure. This object provides a relatively inexpensive failure point, thereby protecting the more costly components of the tool. The links bend, as they are made of aluminum, and contain a cavity in the middle thereby creating a thin wall section. The bending occurs when the links are subjected to excess force, such as plugging the tool into a source having a higher pressure output or inadvertently setting the pump pressure relief too high.

A final object of the invention is that an area of the piston is enlarged to provide additional power on the inward stroke of the implement unit. Standard hydraulic cylinders normally have the area of the inward stroke reduced by the diameter of the piston rod. The instant invention, on the other hand, has a piston rod with a rebated diameter that is two times smaller than a normal piston, which provides additional surface area for hydraulic pressure when retracting an implement unit.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
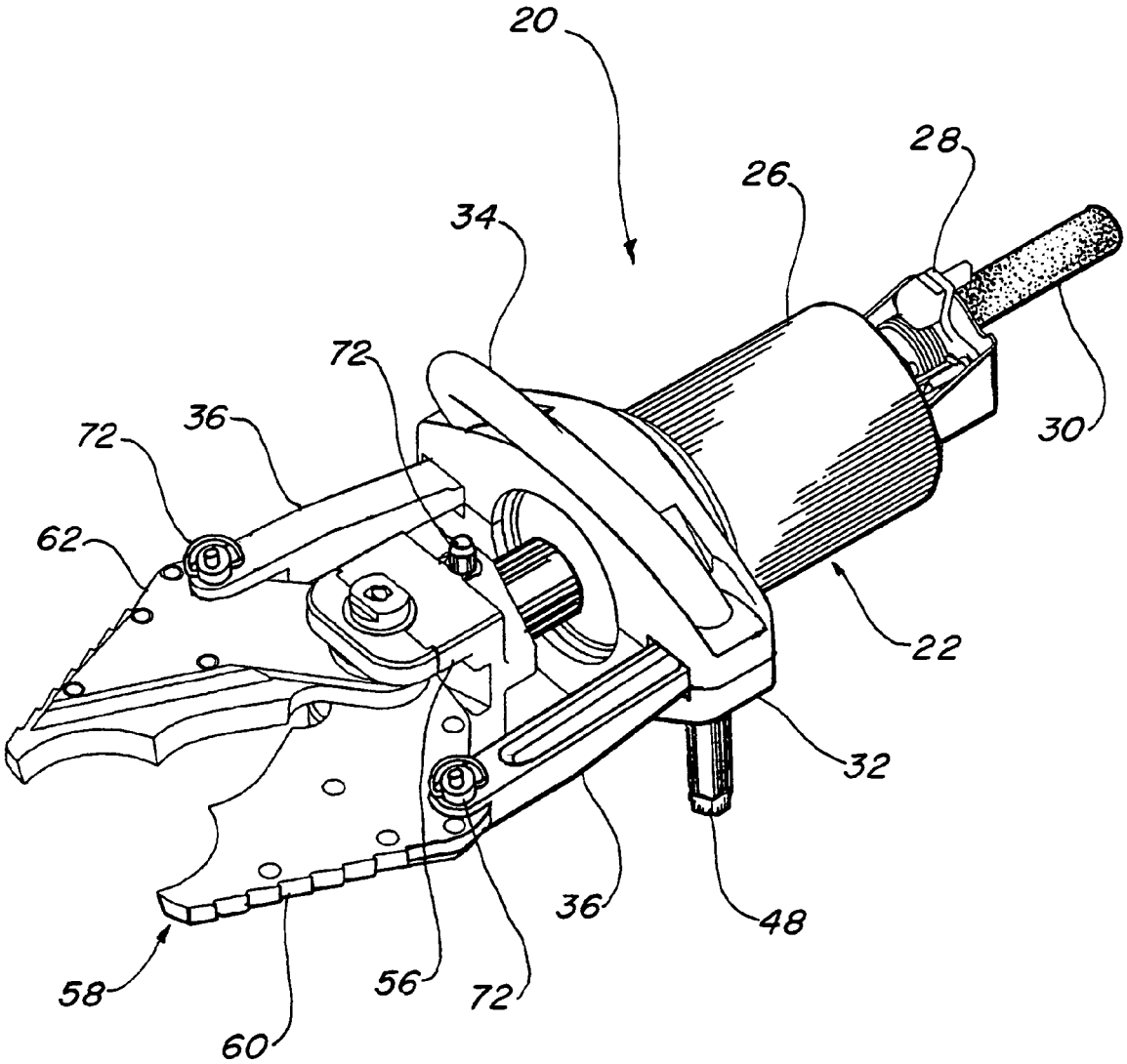
FIG. 1 is a partial isometric view of a hydraulic rescue tool complete with a cutting implement in the preferred embodiment

The best mode for carrying out the invention is presented in terms of a preferred embodiment. The preferred embodiment, as shown in FIGS. 1 through 17, is comprised of a rescue tool 20, preferably using hydraulics in the form of a hydraulic cylinder 22 including a piston rod 24 within a cylinder housing 26 creating the requisite linear drive means. The piston rod 24 extends outward and retracts inward, thus creating a pushing and pulling action. It should be noted, however, that while the hydraulic cylinder 22 is the preferred means, other methods may be used with equal ease, such as pneumatic cylinders, electric linear drive mechanisms, pyrotechnic devices, or any drive that utilizes a ram or arm that moves in a linear direction.

For convenience of operation, hydraulic controls 28 for the cylinder are attached at the end of the cylinder 22, opposite the piston rod 24, as shown in FIGS. 1–4. The controls 28 cause the piston rod 24 to extend or retract and are well known in the art and used in similar applications. For ease of handling the rescue tool 20, a rear handle 30 is attached directly to the hydraulic cylinder or specifically to the controls 28, which are housed within a bracket attached to the end of the cylinder housing 26. It should be noted that the handle 30 and control bracket, in the configuration illustrated, are only the preferred manner of handling as other manual holding devices may also be used.

A cylinder yoke 32, shown assembled on the tool in FIGS. 1–4, is rotatably attached to the hydraulic cylinder housing 26. The cylinder yoke 32 includes means for manipulating the tool by hand in the form of a front handle bar 34 that is used in conjunction with the rear handle 30. The rotation of the cylinder yoke 32 relative to the cylinder 22 prevents injury to an operator in the event that the tool binds and torques, thereby trapping an operator's hand.

Figure 5:
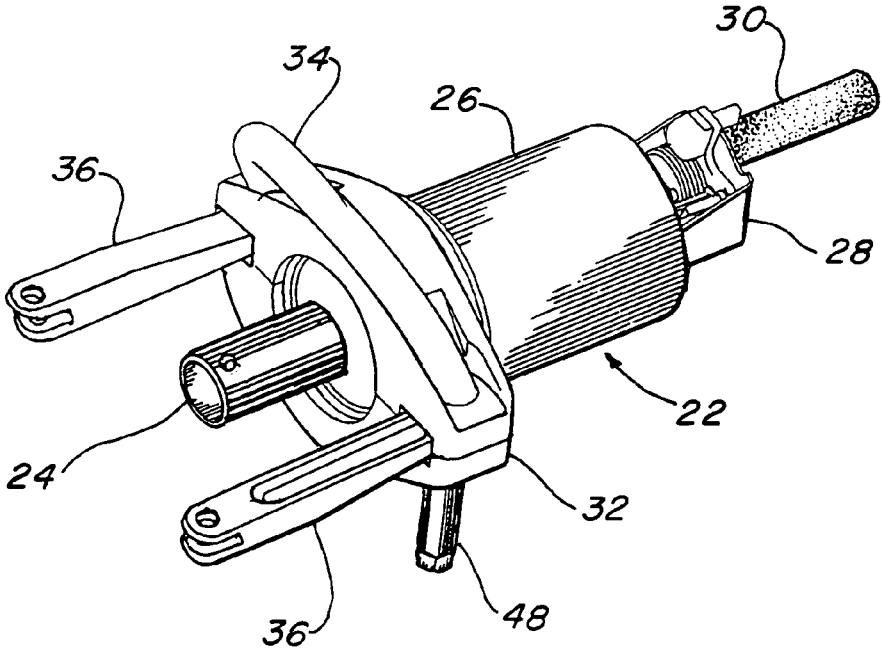
FIG. 5 is a partial isometric view of a hydraulic cylinder, cylinder yoke, and pivotal links of the preferred embodiment completely removed from the invention for clarity.
Figure 6:
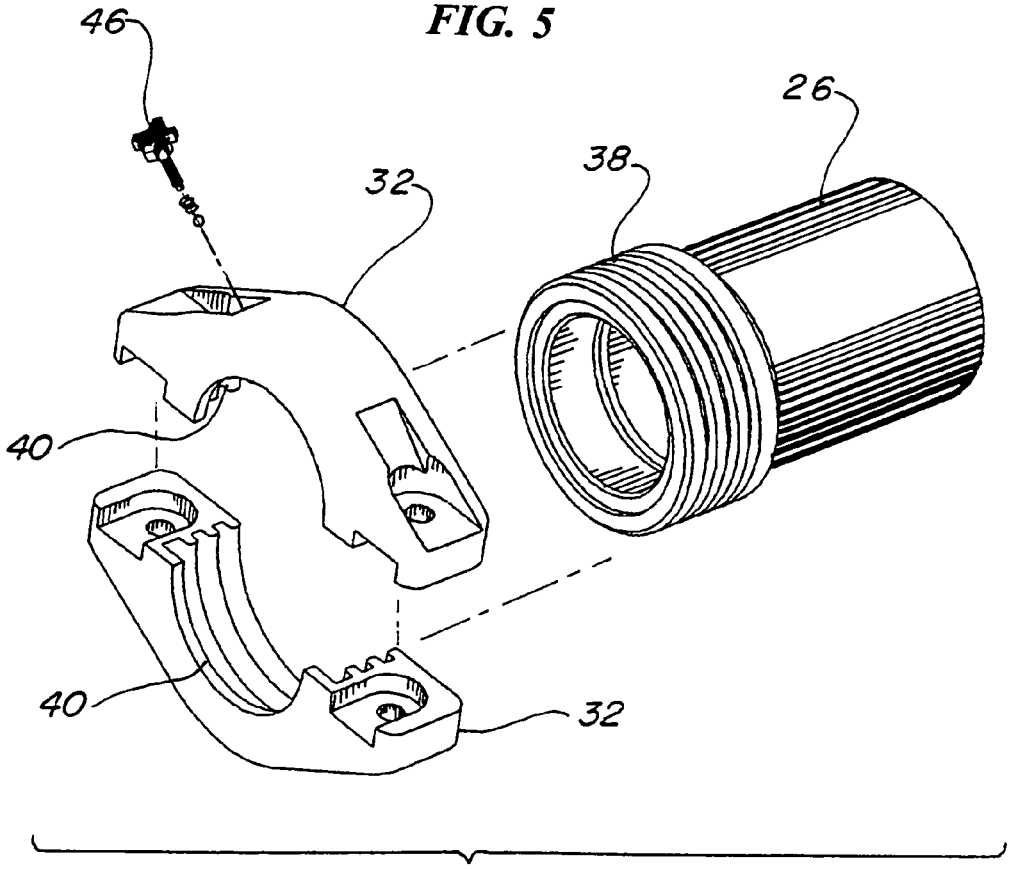
FIG. 6 is an exploded view of the hydraulic cylinder and the cylinder yoke completely removed from the invention for clarity.

The cylinder yoke 32 is made in two opposed pieces and is illustrated by itself removed from the tool 20 in FIG. 6. The yoke 32 includes a pair of pivotal links 36 that are attached thereunto, as shown in FIG. 5. The hydraulic cylinder 22 contains a number of internal grooves 38 and the cylinder yoke 32 includes mating external lands 40. The piston rod 24 utilizes a wet seal between the cylinder 22 and the internal end 42 of the piston rod 24, which is in turn attached to a piston sealing member 44 with a threaded fastener. This arrangement of the sealing member 44 interfacing with the inside of the hydraulic cylinder 22 is illustrated in the section view of FIG. 16 and forms the wet seal. The wet seal permits both the yoke 32 and the rod 24 to revolve in unison from the hydraulic cylinder 22 to protect an operator in the event that the tool binds and torques.

In order to adjustably restrain and govern the rotation of the cylinder yoke 32, a drag control and locking mechanism is incorporated into the yoke itself which is preferably a spring-loaded ball detent 46 that is screwed into a flat that is machined in the cylinder yoke 32. The ball of the detent 46 engages the hydraulic cylinder housing 26 adjacent to the internal grooves 38, and functions by tightening the mechanism, thereby adjustably increasing the drag to a point of complete locking engagement which may be adjusted to completely disable the rotation of the cylinder 22 relative to the yoke 32. The primary adjustment utilizes the front handle bar 34 which attaches the two pieces of the cylinder yoke 32 together with threaded ends that are secured with a pair of internally threaded, extended sleeves 48, thus creating the initial amount of resistance against the torque of the tool.

An implement unit 50 is detachably disposed onto the piston rod 24 on its extending end 52 in conjunction with the pivotal links 36, and its utility is to cut, crush or spread metal during a rescue. There are at least two common types of units 50 that may be used with the invention, with each providing a specialized function. The first type of unit 50 is a cutter 54, as illustrated in FIGS. 7 and 8, that is used for severing material, such as found in vehicle crashes when the vehicle is deformed and must be quickly cut away or into in order to rescue trapped persons.

While cutters 54 are well known in the art, improvements have been made that distinguish the invention over those units that are now in usage. The improved cutter unit 54 consists of a two-piece cutter clevis 56 that is attached to the piston rod 34 on its extending end 52, and a pair of cutting blades 58 that are attached one on top of the other onto the cutter clevis 56. The blades 58 operate in a conventional manner when the piston rod 24 is retracted within the hydraulic cylinder housing 26. The blades 58 rotate towards each other on a common pivot in scissor fashion, thus forming a cutting surface therebetween.

Figure 7:
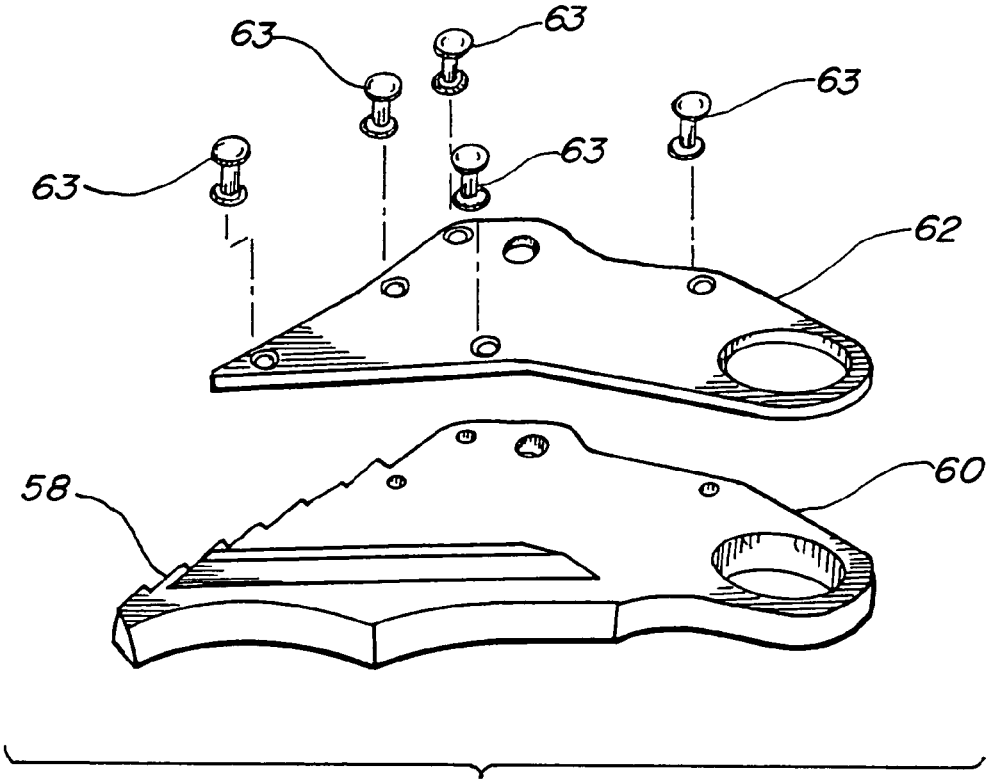
FIG. 7 is an exploded view of one of the cutter blades illustrating a primary blade and a backup plate and a plurality of attaching rivets in the preferred embodiment.
Figure 8:
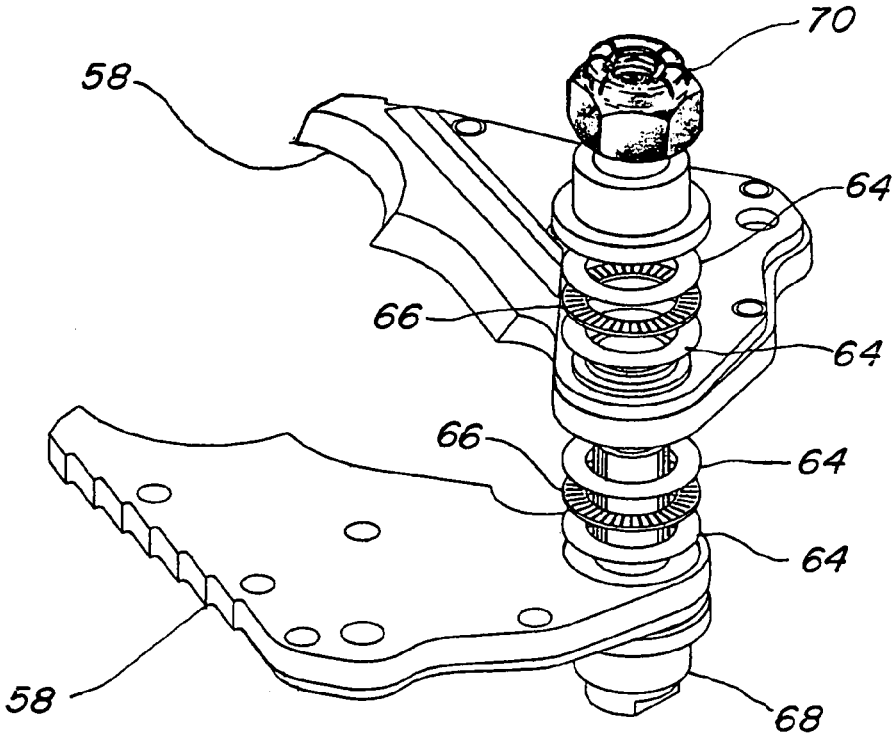
FIG. 8 is an exploded view of one of the pair of cutter blades illustrating the blade assemblies, thrust washers, roller bearings and attaching bolt and nut of the scissor embodiment completely removed from the invention for clarity.
Figure 9:
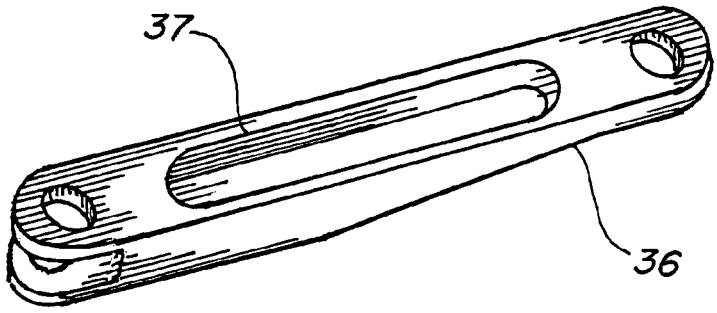
FIG. 9 is a partial isometric view of one of the pivotal links in the preferred embodiment completely removed from the invention for clarity.
Figure 10:
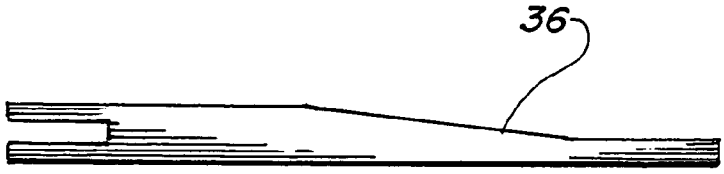
FIG. 10 is a left side view of one of the pivotal links completely removed from the invention for clarity.
Figure 11:
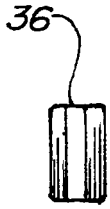
FIG. 11 is a left end view of one of the pivotal links completely removed from the invention for clarity.
Figure 12:
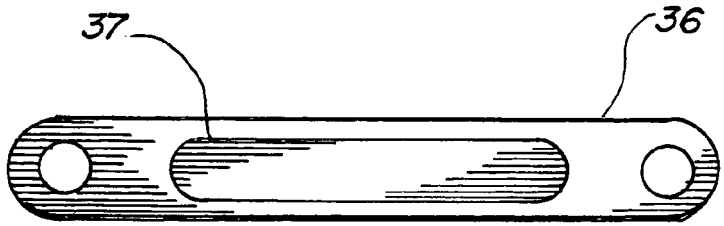
FIG. 12 is a top view of one of the pivotal links completely removed from the invention for clarity.
Figure 13:
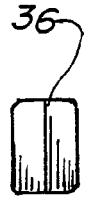
FIG. 13 is a right end view of one of the pivotal links completely removed from the invention for clarity.
Figure 14:
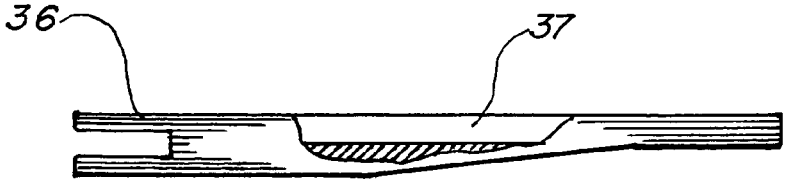
FIG. 14 is a cutaway right side view of one of the pivotal links completely removed from the invention for clarity.
Figure 15:
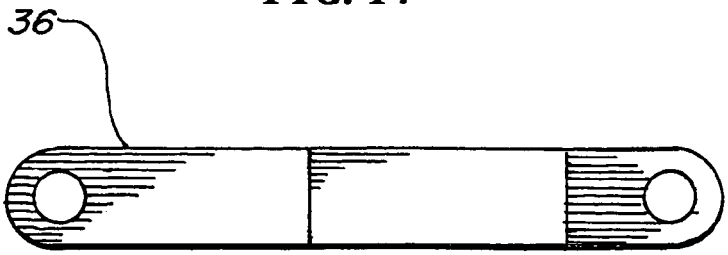
FIG. 15 is a top view of one of the pivotal links completely removed from the invention for clarity.

Each cutting blade 58 consists of a primary blade 60 and a backup plate 62, as shown in FIG. 7. The primary blade 60 has-a sharp cutting edge and the backup plate 62 has sufficient structural integrity to reinforce the primary blade 60 and to preclude breakage and flying into pieces. The backup plate 62 may be fabricated by a process including machining, casting and forging a single element, or two-piece construction with the pieces welded together. The primary blade 60 and backup plate 62 are preferably attached together using a plurality of rivets 63, however bolts and brazing together in a furnace is also acceptable. The cutter 54, as shown in FIG. 8, preferably consists of the pair of opposed blades 58 attached together with a plurality of thrust washers 64 and roller bearings 66, and held jointly with a pivot bolt 68 and a pivot nut 70 thorough the cutter clevis 56, which forces the cutting blades tightly together.

Figure 2:
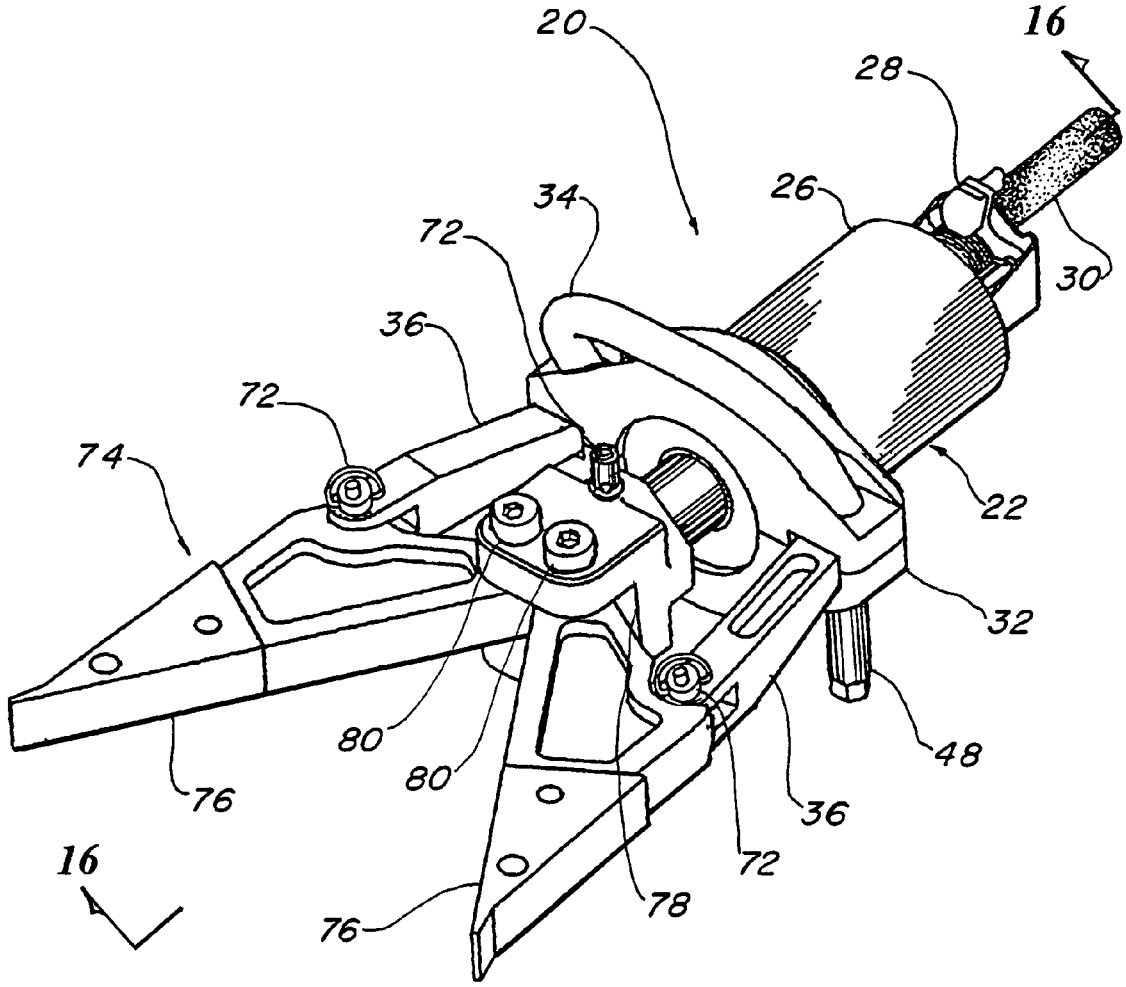
FIG. 2 is a partial isometric view of the hydraulic rescue tool complete with a spreader implement in the preferred embodiment
Figure 4:
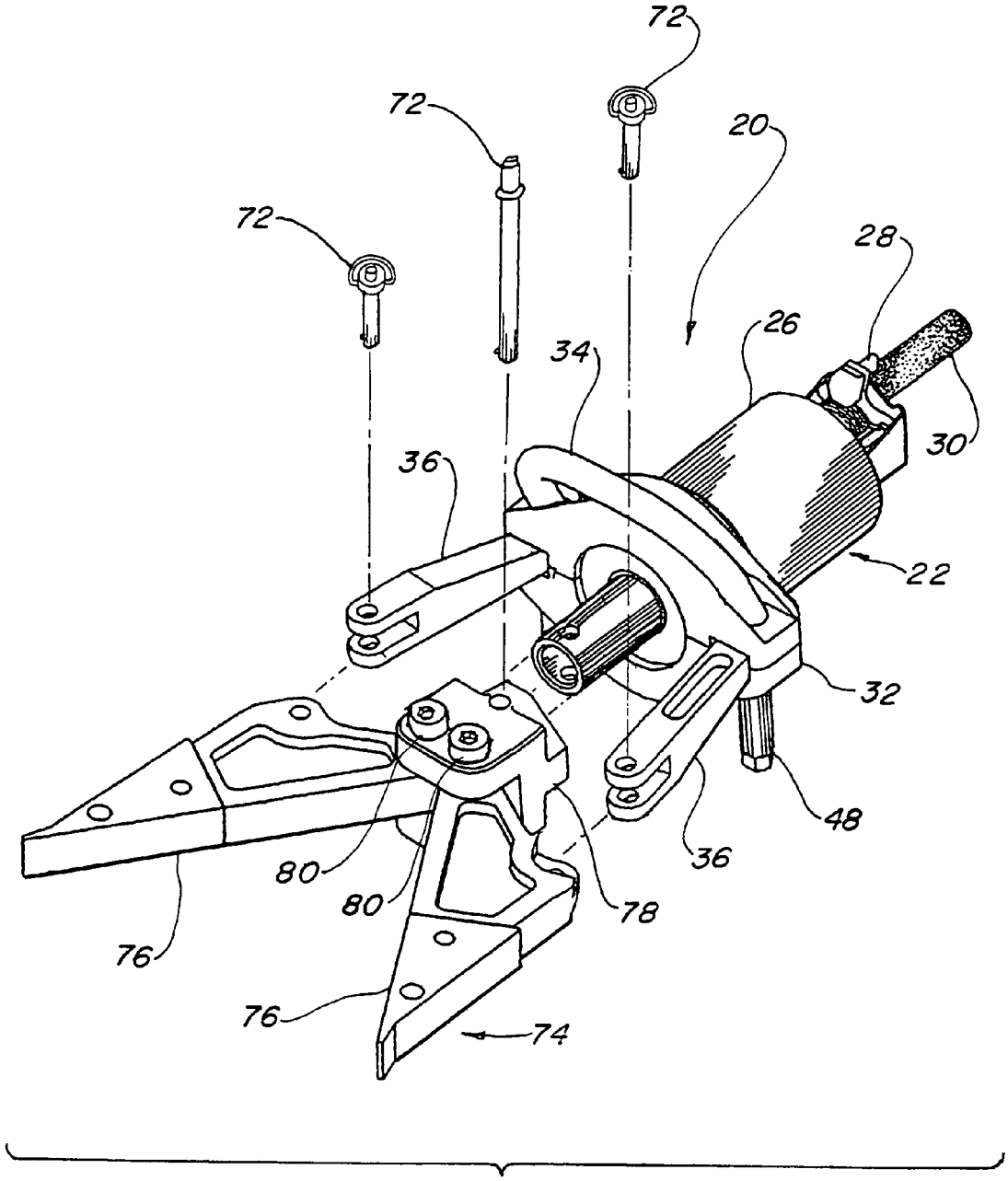
FIG. 4 is a partial exploded isometric view of the hydraulic rescue tool with the spreader implement removed in the preferred embodiment

The second type of implement unit 50 is a spreader 74, as shown in FIGS. 2 and 4, that is used for prying apart vehicle elements when the vehicle is deformed and material must be quickly crushed or broken away to rescue a victim trapped within. The spreader 74 has a pair of spreader arms 76 and a spreader clevis 78. The clevis 78 attaches both arms 76 so that they pivotally arc into a spread-open position when the cylinder piston rod 24 is retracted, and intimately engage in a closed position with each other when the rod 24 is extended. The spreader clevis 78 utilizes a spreader pivot bolt 80 that connects each spreader 74 to the spreader clevis 78, as also shown in FIGS. 2 and 4.

Figure 3:
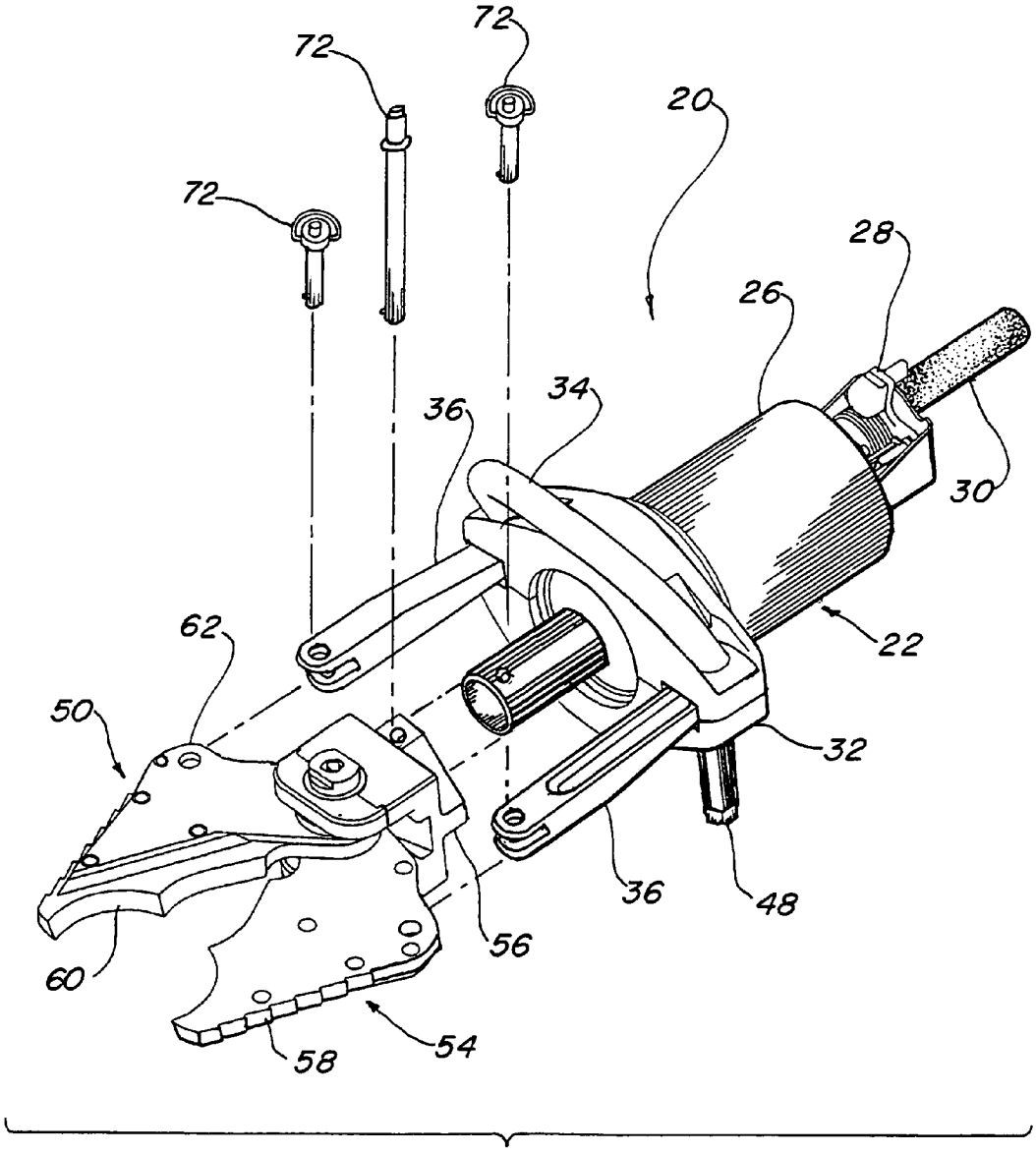
FIG. 3 is a partial exploded isometric view of the hydraulic rescue tool with the cutting implement removed in the preferred embodiment

The novelty of having an implement unit 50 that is quickly removable without tools provides a significant advantage over rescue tools presently used in the art. A set of quick release pins 72 attach the implement unit 50 to the piston rod 24 and the pivotal links 36, thereby providing a rapid release of the implement unit 50 from the piston rod 24 and links 36. The release may be accomplished by manually removing only three pins 72, as shown in FIGS. 3 and 4, for replacement or repair of the unit 50, either in the field or at a maintenance facility.

The links 36 that have the fail-safe feature are illustrated in FIGS. 9–15 and are constructed of an aluminum material having a cavity 37 therein along a longitudinal surface. The absence of material within the cavity 37 provides a bendable section for failing in a safe manner in the event of over pressurization of the hydraulic cylinder 22 or any other excessive force linear driving means. It may be clearly visualized that by having an area that is smaller in cross section and the material being aluminum, will cause the link structure to bend or yield at the weakest point. The weakest point is located at the cavity 37 of the link 36, which allows the link 36 to be easily replaced. The link 36 is significantly less costly than other components, therefore protecting the major components of the rescue tool 20.

Figure 16:
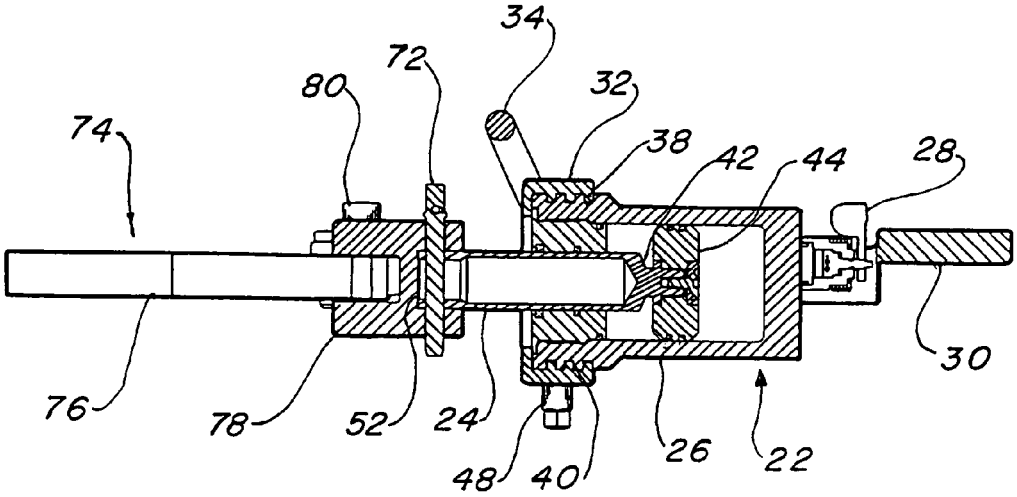
FIG. 16 is a cross-sectional view taken along lines 16—16 of FIG. 2 illustrating the piston within the cylinder housing.
Figure 17:
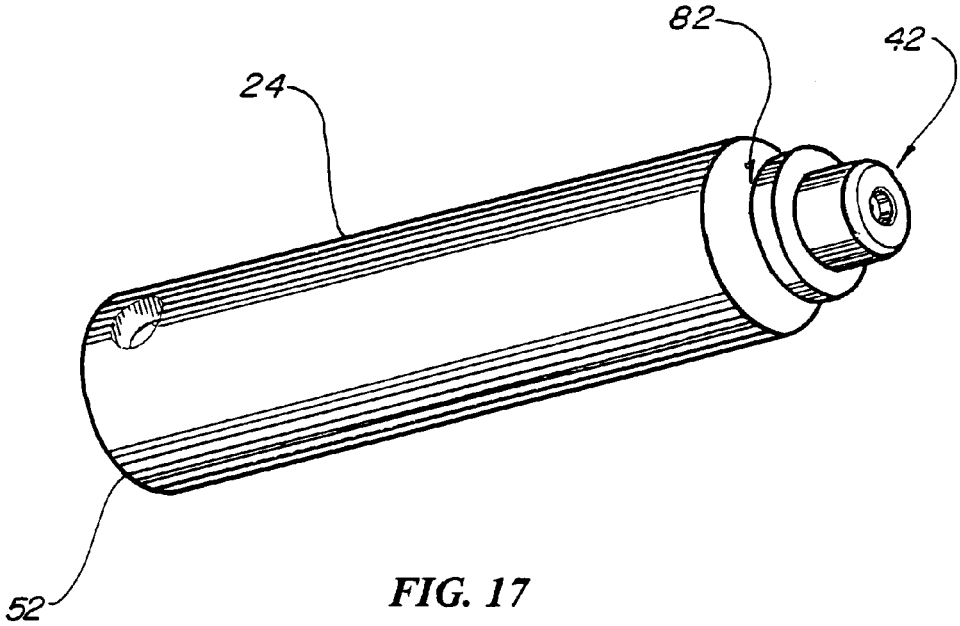
FIG. 17 is a partial isometric view of the piston rod of the preferred embodiment completely removed from the invention for clarity.

A final feature of the invention provides additional power on the inward stroke to the implement unit 50 by increasing the cross sectional area on the piston sealing member 44. In conventional hydraulic cylinders 22, the inward stroke of the sealing member is reduced by the area of the diameter of the piston rod since it is normally attached directly to the sealing member. The invention utilizes a piston rod 24 that has an extending end 52 and an internal end 42, with the internal end 42 having a rebated diameter 82 at least two times smaller than the piston extending end 52, as illustrated in FIGS. 16 and 17. This reduction in diameter provides additional surface area for hydraulic pressure when retracting an implement unit attached to the extending end.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the invention

The invention claimed is:

1. A hydraulic rescue tool comprising:

a) a hydraulic cylinder having a housing, a piston rod, and hydraulic controls, with said piston rod movably disposed within said housing, thus providing linear driving means for the rescue tool, b) a cylinder yoke rotatably attached to the hydraulic cylinder housing, said cylinder yoke having means for manipulating the tool by hand, with rotation of the cylinder yoke relative to the cylinder, thereby preventing injury to an operator in the event that the tool binds and torques, said cylinder yoke further having a pair of pivotal links attached thereunto, c) an implement unit detachably disposed onto said piston rod and said pivotal links for cutting or spreading metal, and d) a plurality of quick release pins attaching said implement unit in concert with said piston rod and said pivotal links, thus providing a rapid release of the implement unit from the piston rod and links for replacement or repair.

2. The hydraulic rescue tool as recited in claim 1 wherein said hydraulic cylinder further having internal grooves and said cylinder yoke having mating external lands, and wherein said piston rod having a wet seal between the cylinder and the piston rod that permits both the yoke and the piston rod to revolve in unison from the hydraulic cylinder.

3. The hydraulic rescue tool as recited in claim 2 further comprising a drag control and locking mechanism that is defined as a spring-loaded ball detent disposed within said cylinder yoke, with the ball of the detent engaging the hydraulic cylinder adjacent to said internal grooves, such that tightening the mechanism increases drag to a point of locking engagement, thereby disabling rotation of the cylinder relative to the yoke.

4. The hydraulic rescue tool as recited in claim 1 wherein said implement unit further comprises a cutter for severing material such as found in vehicle crashes when a vehicle is deformed and the material must be quickly cut away to rescue trapped persons.

5. The hydraulic rescue tool as recited in claim 4 wherein said cutter further comprises a two-piece cutter clevis attached to said piston rod on one end, and a pair of cutting blades attached to the cutter clevis on the other, such that when the piston rod is retracted within the hydraulic cylinder housing the blades rotate towards each other on a common pivot in scissor fashion, thus forming a cutting surface therebetween.

6. The hydraulic rescue tool as recited in claim 5 wherein each cutting blade further comprises a primary blade and a backup plate, with the primary blade having a sharp cutting edge and the backup plate having significant structural integrity for reinforcing the primary blade and to preclude the blade breaking and flying into pieces.

7. The hydraulic rescue tool as recited in claim 6 wherein said backup plate is fabricated by a process selected from the group consisting of: machining, casting, forging a single element, and a two-piece construction with the pieces welded together.

8. The hydraulic rescue tool as recited in claim 6 wherein said primary blade and said backup plate are attached together by a process selected from the group consisting of: a plurality of rivets, a plurality of bolts, and brazing together in a furnace.

9. The hydraulic rescue tool as recited in claim 5 wherein said cutter further comprises a plurality of thrust washers and a plurality of roller bearings that are spaced between said a pair of cutting blades and held jointly with a pivot bolt and a nut, thereby forcing the cutting blades tightly together.

10. The hydraulic rescue tool as recited in claim 1 wherein said implement unit further comprises a spreader that is defined as a pair of spreader arms and a spreader clevis which attaches both arms in such a manner that they pivotally arc into a spread-open position and intimately engage with each other in a closed position.

11. The hydraulic rescue tool as recited in claim 10 wherein said spreader clevis further comprises a spreader pivot bolt connecting each spreader to said spreader clevis.

12. The hydraulic rescue tool as recited in claim 1 wherein said pivotal links further having a cavity therein along a longitudinal surface that provides a bendable section for failing in a safe manner in the event of over pressurization of the hydraulic cylinder.

13. The hydraulic rescue tool as recited in claim 12 wherein said pivotal links are constructed of an aluminum material.

14. The hydraulic rescue tool as recited in claim 1 wherein said piston rod further having an extending end and an internal end, with said internal end having a diameter rebated at least two times smaller than the extended end.

15. A rescue tool comprising:

a) linear driving means having a pair of pivotal links and a piston rod, with said piston rod movably providing a pushing and a pulling action for the rescue tool, b) an implement unit detachably connected to said piston rod and said pivotal links for cutting and spreading metal during a rescue, c) a plurality of quick release pins attaching said implement unit in concert with said piston rod and said pivotal links, thereby providing a rapid release of the implement unit from the piston rod and pivotal links for quick replacement or repair, and d) said pivotal links having a cavity therein along a longitudinal surface that provides a bendable section for failing in a safe manner in the event of excessive force created by said linear driving means.

16. A hydraulic rescue tool comprising:

a) a hydraulic cylinder, having a cylinder housing with a piston rod and a cylinder yoke rotatably attached to said cylinder housing, thus providing a pushing and a pulling action for the rescue tool, b) said hydraulic cylinder housing having internal grooves, said cylinder yoke having mating external lands, and said piston rod having a wet seal between the cylinder housing and the piston rod, and c) said cylinder yoke having means for manipulating the tool by hand, which permits both the cylinder yoke and piston rod to revolve in unison relative to the hydraulic cylinder housing, thereby preventing injury to an operator in the event that the tool binds and torques.

17. A rescue tool comprising:

a) linear driving means having a piston rod and pivotal links providing a pushing and a pulling action for the rescue tool, b) an implement unit connected to said linear driving means for cutting and spreading metal during a rescue, c) said implement unit comprises a cutter for severing material such as found in vehicle crashes when the vehicle is deformed and the material must be quickly cut away to rescue trapped persons, d) said cutter further comprises a pair of cutting blades such that when the linear driving means is retracted the cutting blades rotate towards each other on a common pivot in scissor fashion, thus forming a cutting surface therebetween, e) each cutting blade comprises a primary blade and a backup plate, with the primary blade having a sharp cutting edge and the backup plate having significant structural integrity, f) said backup plate fabricated by a process selected from the group consisting of: machining, casting, forging a single element, and two-piece construction with the pieces welded together, g) a plurality of quick release pins attaching said implement unit in concert with said piston rod and said pivotal links, thus providing a rapid release of the implement unit from the piston rod and links for replacement or repair, and h) said pivotal links having a cavity therein along a longitudinal surface that provides a bendable section for failing in a safe manner in the event of excessive force created by said linear driving means.

18. A rescue tool comprising:

a) linear driving means having a pair of pivotal links, said linear driving means providing a pushing and a pulling action for the rescue tool, and b) said pivotal links having a cavity therein along a longitudinal surface that provides a bendable section for failing in a safe manner in the event of excessive force created by said linear driving means.

19. A hydraulic rescue tool comprising:

a) a hydraulic cylinder, which has a hydraulic housing and a piston rod, that provides a pushing and a pulling action for the rescue tool, and b) said piston rod having an extending end and an internal end, with said internal end having a diameter rebated at least two times smaller than the piston extending end.

* * * * *